US005228509A

United States Patent [19]

Ungemach et al.

[11] Patent Number: 5,228,509

[45] Date of Patent: Jul. 20, 1993

[54] DEVICE FOR PROTECTING WELLS FROM CORROSION OR DEPOSITS CAUSED BY THE NATURE OF THE FLUID PRODUCED OR LOCATED THEREIN

[76] Inventors: Pierre Ungemach, 2 Rue Rameau, F-60300 Senlis; Roland Turon, 6 Allée Richard Wagner, F-94320 Villepinte, both of France

[21] Appl. No.: 768,630

[22] PCT Filed: Feb. 22, 1991

[86] PCT No.: PCT/FR91/00148

§ 371 Date: Oct. 22, 1991

§ 102(e) Date: Oct. 22, 1991

[87] PCT Pub. No.: WO91/13234

PCT Pub. Date: Sep. 5, 1991

[30] Foreign Application Priority Data

Feb. 22, 1990 [FR] France ..... 90 02206

[51] Int. Cl.[5] ..... E21B 37/06

[52] U.S. Cl. ..... 166/208; 166/304; 166/902

[58] Field of Search ..... 166/208, 902, 304, 311, 166/312

[56] References Cited

U.S. PATENT DOCUMENTS

| | | | |
|---|---|---|---|
| 4,057,108 | 11/1977 | Broussard | 166/310 |
| 4,424,862 | 1/1984 | Munari et al. | 166/168 |
| 4,494,607 | 1/1985 | Ford et al. | 166/902 X |
| 4,615,387 | 10/1987 | Johnson et al. | 166/242 |
| 5,048,603 | 9/1991 | Bell et al. | 166/902 X |
| 5,103,914 | 4/1992 | LaHaye | 166/902 X |

FOREIGN PATENT DOCUMENTS

| | | |
|---|---|---|
| 2463197 | 8/1980 | France . |
| 2631708 | 5/1988 | France . |

*Primary Examiner*—Terry Lee Melius
*Attorney, Agent, or Firm*—Larson & Taylor

[57] ABSTRACT

Device for protecting wells from the risks of corrosion and deposits due to the nature of the fluid produced or present in the well. It is formed of a steel support casing (2), associated with a composite material production string (3), with a free annular space (6) particularly for the injection of inhibiting agents without stopping working. The string (3) is laid on the casing (2) via a device (4) which may be lowered at the same time as the string (3) and which has openings (13) ensuring the hydraulic continuity of the annular space (6). The device is particularly well adapted to wells conveying fluids which are aggressive with respect to traditional steel casings.

11 Claims, 4 Drawing Sheets

(PRIOR ART)

DEVICE FOR PROTECTING WELLS FROM CORROSION OR DEPOSITS CAUSED BY THE NATURE OF THE FLUID PRODUCED OR LOCATED THEREIN

The present invention relates to a new concept of well completion using a steel support casing associated with a composite material injection or production string, with free annular space.

The invention applies in particular to the construction of geothermal wells for combatting the effects of the corrosive and scale-forming thermochemistry of the geothermal fluid and preserving the long-life of the structures. These problems are particularly well known, for example, in the Paris basin where numerous geothermal "doublets" (assembly formed of a production well for collecting the hot water of the reservoir and an injection well used for re-injecting fluid into the reservoir after heat has been extracted) have been realized from the 1970s.

In these installations, the geothermal fluid—hot water whose temperature is between 50° C. and 85° C. and with high salinity (15 to 25 g/l)—comprises a dissolved gas phase enriched with C02 and H2S which confer thereon a slight acidity (pH of 6 to 6.4). This aggressiveness results, in certain zones of the harnessed reservoir, in repeated and accelerated damage to the structures because of the corrosion and deposits affecting the casings and clogging affecting the collection zone of the reservoir.

The damage mechanism may be summed up as follows:

- corrosion of the casing of the production well and, to a lesser extent, of the injection structure;
- dissolution of the iron of the casing with formation of a solution and formation of iron sulphides;
- deposits of the sulphides on the walls of the steel of the production casing without protection thereof (continuation of the corrosion kinetics under the deposits);
- entrainment in a particular form (solid suspensions) in the water produced and clogging of the heat exchangers, deposits/scaling of the injection casing and accumulation on the bottom and on the walls of the reservoir collection zone;
- increase of the pressure losses, reducing the flowrate of the geothermal loop and clogging of the structures and surface equipment.

The curative and preventive means for, if not eradicating, at least reducing such damage are of three kinds:

- curative means: the wells are freed of their deposits by lowering, with rotation and mud flow, of conventional cable and rod fittings, well known to specialists; specific products for reducing the costs of such trouble-shooting have been provided; the French patent 2 631 708 describes one of these devices based on a coiled tubing system;
- chemical preventive means based on the injection at the bottom of the well of corrosion inhibiting-/deposit agents with respectively film-forming (corrosion) and dispersant (deposits) functions. Such injection is carried out using an auxiliary injection tube (AIT), the positioning and resistance in time of which are also subject to caution; the French patents 2 463 197 and 2 502 239 describe respectively an inhibiting method by injecting aliphatic amines and a well bottom injection device;

- alternative solutions for the materials: they are based on the use of either resistant materials or, preferably, materials which are electro-chemically inert with respect to corrosion in the H2O—CO2—H2S system. The choice of noble alloys (Cr, Mo, Ni, etc. . . . ), of a high cost, have moreover the drawback of making the solid structure fragile in the presence of dissolved H2S, in a low concentration, which does not exist with the carbon steels usually used. The composite materials are passive from the corrosion point of view; positioning thereof in the borehole, however, is not without risk because of the mechanical characteristics of the material used. For the same reason, this risk of damage exists at the time of interventions during working. The simple friction of a cable, used for lowering electric well-logging tools, may create at points a hole in the thickness of the casing.

This reveals the fact that the use of conventional solutions for overcoming well damage problems due to the aggressiveness of the geothermal fluid, comprise non negligible risks.

The invention according to the present application, forms another alternative combining the possibilities of chemical preventive means and material alternatives without having the drawbacks thereof.

The invention and its advantages will be better understood from the description of one embodiment illustrated by the accompanying figures in which:

FIG. 1 shows one example of a geothermal production well completion according to the invention;

FIGS. 2, 3 and 4, relative to the prior art, show certain risks inherent in the conventional solutions and avoided in the solution forming the object of the invention;

Figure 1:
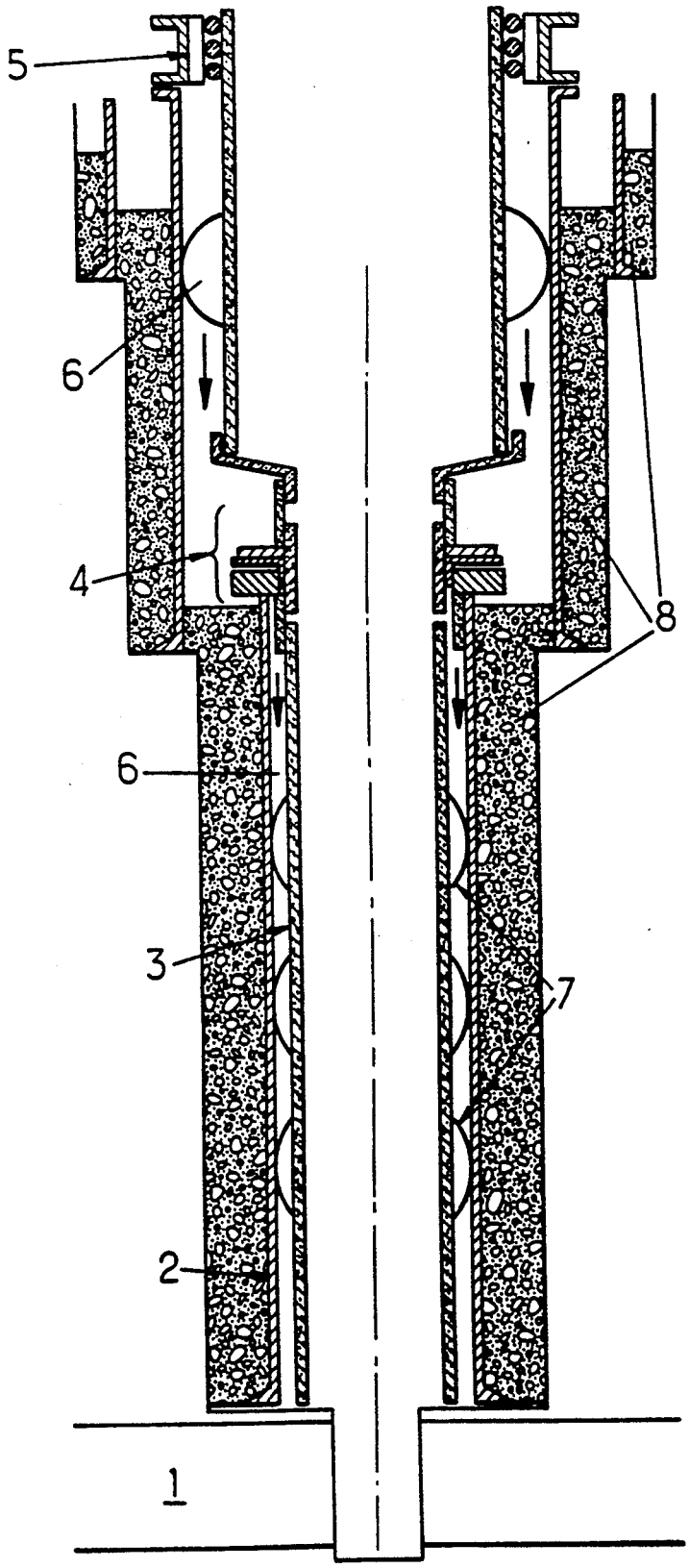

In FIG. 1, the formations as far as the roof of the reservoir 1 to be harnessed are drilled with a large diameter. A traditional support casing 2 is laid and cemented 8 before drilling the reservoir.

After drilling the reservoir, a production string 3 made from composite materials is positioned. For the installation if required of an immersed pump, the upper part of the production string 3 is of large diameter, thus forming a pumping chamber. To avoid "trapping" of the production string between two fixed points, a drawback inherent in the conventional laying systems, this string is positioned by means of a particular device 4 placed at the same time as string 3 is lowered. The lower part of the string is suspended therefrom, which also serves as a seat for the upper part. The expansion of the latter is taken up at the head via a sleeve 5. The other end of the lower part slides freely along its axis in the support casing 2. The string 3 assembly is centered by centering means 7 made from a composite material.

The invention also provides an annular space 6 between the cemented steel casing 2 and the composite material string 3, this annular space 6 being free and reduced.

Thus, in case of steel and composite casings of standard diameters, corresponding to the general productions of manufacturers, the thickness e of the annular space 6 is equal to:

steel casing diameter 18"⅝ e=30 mm
steel casing diameter 13"⅜ e=7.1 mm
steel casing diameter 10"¾ e=13.3 mm steel casing diameter 9"⅝ e=20.1 mm These values may be compared with the completion values generally employed in the oil working field in which, for conventional casing diameters of 9"⅝ and 7", the thickness values are respectively 42 and 66 mm.

The composite material string 3 may be advantageously laid by way of illustration as follows:

- the lower part of the composite material string 3 is lowered into the non eruptive well by gravity, by means of equipment such as casing elevators, hydraulic torque wrenches, winches and procedures used conventionally in the oil working field for laying casings,
- then the seat/receptacle device 4, the engagement connection and the diameter reduction situated above device 4 are fixed by screwing, then the first element of the upper part, of large diameter, of the upper part of the composite material string is screwed on.

In the case where the relative fragility of large diameter string may require it, lowering thereof may be assisted by means of a suspension device of liner hanger type fastened to the first composite string element 3 in a housing provided for this purpose in an adapted connection. After the seat/receptacle 4 has been laid, and not fastened as in the case of a packing, to the lower steel support casing, telescoped with the pumping chamber, the well head is then mounted.

Moreover, receptacle 4 is designed so as to provide hydraulic continuity in the annular space 6.

The annular space 6 between the composite casing 3 and the support casing, which is left free, allows:

- an equal pressure to be obtained inside the production string and the annular space, thus avoiding the creation of forces which may damage the composite material 3 and offering better damping of the pressure shocks and hammering during production;
- the tightness to be checked both of the steel casing 2 and of the composite material string 3.;
- low rate injection from the surface well head of inhibiting agents, without requiring an auxiliary injection tube; any risk inherent in positioning such a device (loss of flowrate, breakage, loss of the tube, shut-down of working) is thus avoided;
- the problems inherent in the foot packer (laying, anchorage, resistance in time) to be avoided.

The injection with a slight overpressure of inhibitors in the annular space 6 avoids any contact (and thus any risk of corrosion) between the geothermal fluid and the support casing 2. Another important advantage is that such injection may take place without stopping working.

Figure 2:
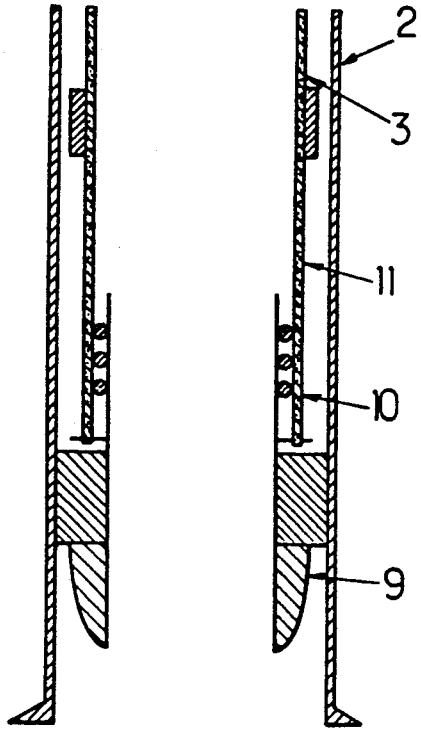
Figure 3:
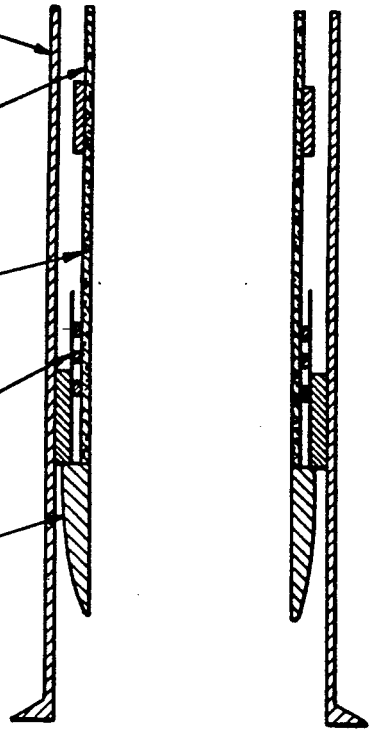
(PRIOR ART) FIG. 3.
Figure 4:
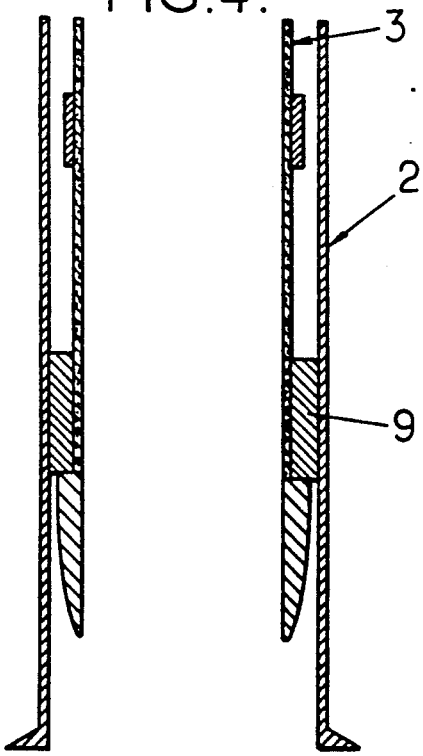
(PRIOR ART) FIG. 4.

The conventional solutions of the prior art, shown in FIGS. 2, 3 and 4, require the positioning of foot packers whose drawbacks are well known to specialists.

The solutions of FIGS. 2 and 3 comprise sliding of the composite material casing 3 in the foot packer 9 via an anchorage "skirt" 11; sliding is external in the solution of FIG. 2 and internal in that of FIG. 3.

The tightness of the annular space in the solutions shown in FIGS. 2 and 3 is provided by seals 10. Such tightness cannot be guaranteed in time. It involves then a special work-over with all the risks in this type of work in a composite casing.

Similarly, since it is often a question of deviated wells, the bases for calculating the tractive force to be applied to the casing, so as to take into account, before anchorage at the well head, of the elongations induced by thermal expansion and mechanically, are often subject to hazards: knowledge of the composite casing/steel casing friction forces, nominal path and actual path of the casings.

The solution shown in FIG. 4 is a simplification of the preceding solutions with the same drawbacks. In addition, the composite casing 3 is held between two fixed points without the possibility of sliding in the skirt of the packer as in the solutions of FIGS. 2 and 3.

The invention of the present application eliminates these drawbacks. The simplicity of design facilitates the laying of the composite casing. The absence of a fixed point at the base allows the stresses which may be introduced by local friction during lowering to be released.

The composite materials of the production string 3 may combine epoxy (resin), aliphatic amines (hardeners) and glass fibres of type E (reinforcement), double filament winding and axial reinforcement; in oil applications, the threaded joints will be of the sleeve coupling types to the API standards. The carbon and polyaramides may form materials alternative to glass in so far as the reinforcement fibres are concerned. To avoid spot wear of string 3 in the case of repeated lowering of well-logging tools, anti-abrasion agents may be added to the composite material forming the casing.

The support tubes 2 may be conventional carbon steel tubes.

Figure 5:
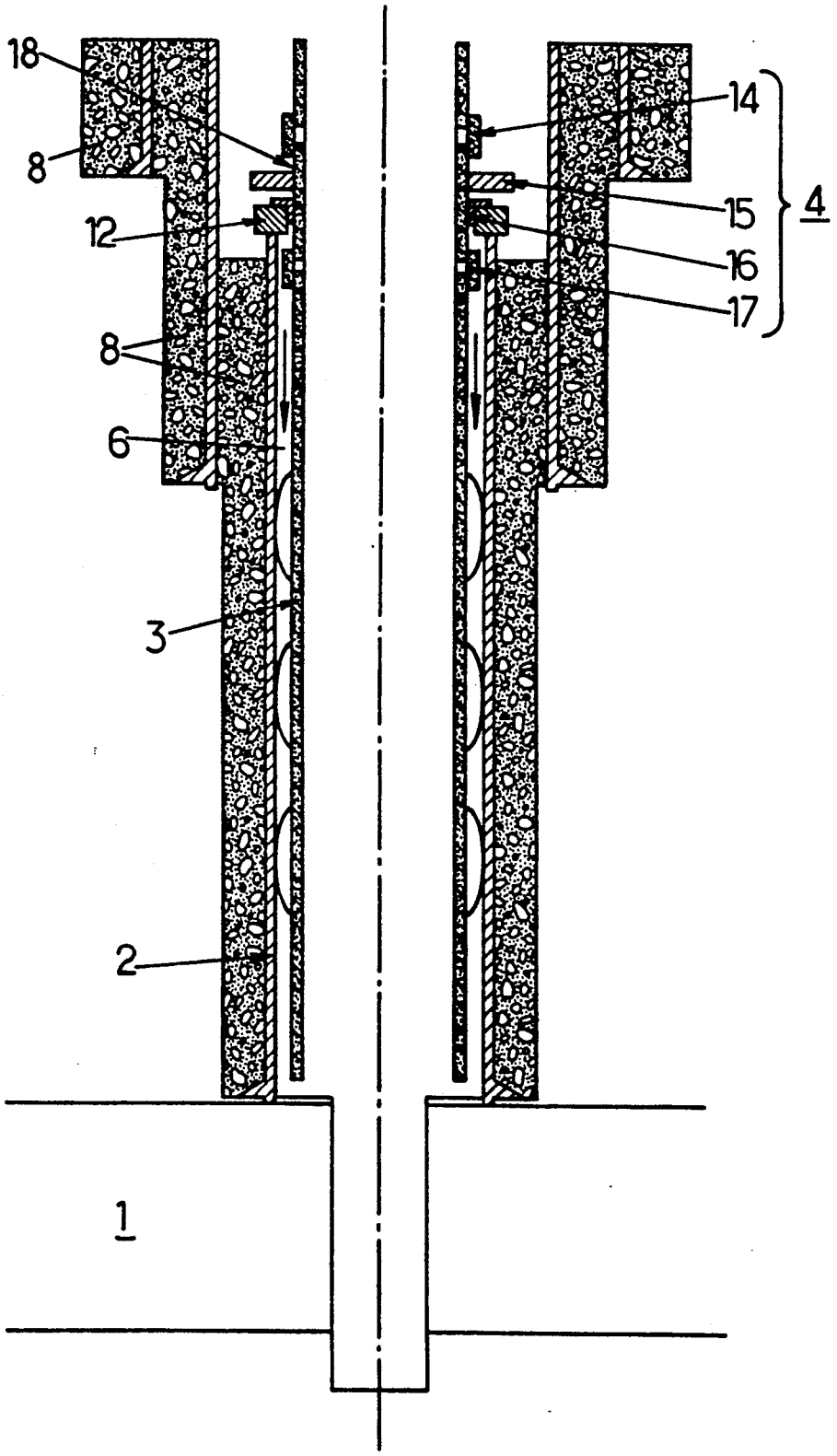
FIG. 5 shows a possible constructional variant of the invention.

FIG. 5 shows a possible application for a geothermal well or conventional oil application well not requiring a pumping chamber.

Figure 6:
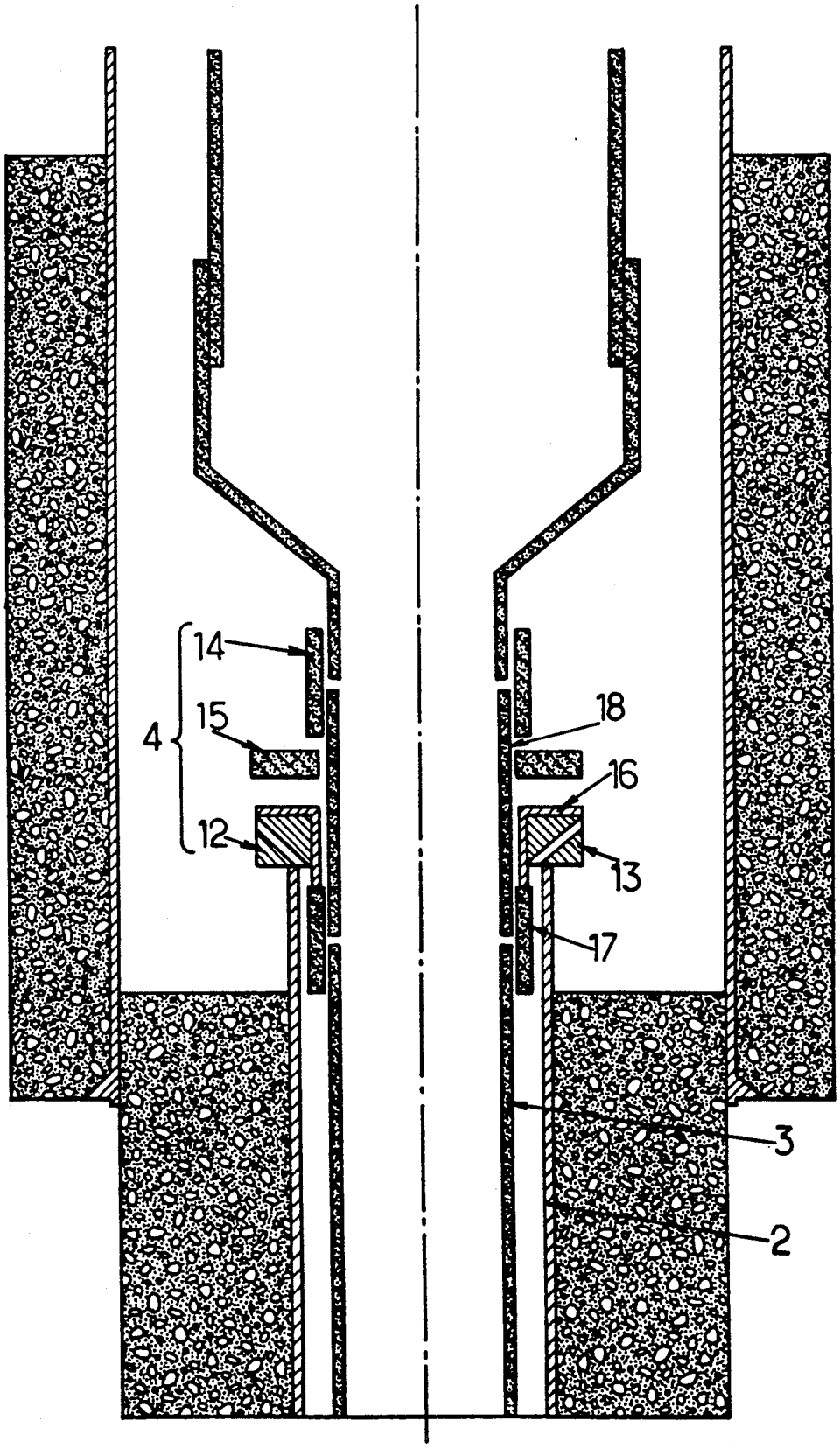
FIG. 6 shows a detail of the invention.

FIG. 6 gives the detail of the seat/receptacle assembly 4.

In a preferred embodiment of the suspension device 4, it is constructed and used as follows:

- the suspension system 4 is maintained during lowering of string 3 in position between an upper sleeve 14 and a lower sleeve 17 of a short tube 18 of string 3, positioned as a function of the dimension of the upper part of the support tube 2 and of the respective lengths of the top and bottom parts of string 3 separated by this tube 18;
- this system 4 further comprises a seat 12 resting on the upper part of the support tube 2 with openings 13 providing hydraulic continuity of the annular space 6;
- this seat 12 supports the whole of string 3 via the upper sleeve 14 resting on a flange 15 and possibly a protection 16 which may for example be a polymer material.

We claim:

1. A well completion system for a well comprising:

a steel support casing including a head positioned and cemented in the well, a string casing associated with said support casing having a lower part and an upper part;

an assembly having a seat resting on said head of said support casing;

a support means for suspending the lower part of said string casing from said assembly and for supporting the upper part of said string casing from said assembly such that an annular space is formed between said support casing and said string casing whereby said support casing is isolated from any fluid passing through said string casing; and a continuity means in said seat of said assembly for providing a path for fluid flow between the annular space above said seat and below said seat whereby said annular space is usable for injection of corrosion inhibiting agents into the well.

2. A well completion system as claimed in claim 1 wherein said string casing is made from composite materials.

3. A well completion system as claimed in claim 1 wherein said support means suspends and supports said string casing during a lowering and positioning of said assembly and said string casing in the well.

4. A well completion system as claimed in claim 1 wherein said support means includes a protection material on an upper portion of said seat, a flange located above said seat which bears vertically against said protection material and said seat, a short tube located between said upper part and said lower part of said string casing, an upper sleeve attached to said upper part of said string casing and said short tube which bears vertically against said flange, and a lower sleeve attached to said lower part of said string casing and said short tube; and wherein said continuity means includes openings through said seat.

5. A well completion system as claimed in claim 2 wherein said composite materials of said string casing include epoxy resin, aliphatic amines as hardeners, type E glass fibre reinforcement, double filament winding, and axial reinforcement.

6. A well completion system as claimed in claim 5 wherein said composite materials of said string casing include anti-abrasion agents.

7. A well completion system as claimed in claim 5 wherein said reinforcement fibers are made from one of carbon or polyaramide.

8. A well completion system as claimed in claim 7 wherein said composite materials of said string casing include anti-abrasion agents.

9. A well completion device for a well including a) a steel support casing including a head positioned and cemented in the well and b) a string casing associated with the support casing having a lower part and an upper part, said completion device comprising:

an assembly having a seat resting on the head of the support casing;

a support means for suspending the lower part of the string casing from said assembly and for supporting the upper part of the string casing from said assembly such that an annular space is formed between the support casing and the string casing whereby the support casing is isolated from any fluid passing through the string casing; and a continuity means in said seat of said assembly for providing a path for fluid flow between the annular space above said seat and below said seat whereby said annular space is usable for injection of corrosion inhibiting agents into the well.

10. A well completion system as claimed in claim 9 wherein said support means suspends and supports said string casing during a lowering and positioning of said assembly and said string casing in the well.

11. A well completion system as claimed in claim 9 wherein said support means includes a protection material on an upper portion of said seat, a flange located above said seat which bears vertically against said protection material and said seat, a short tube located between said upper part and said lower part of said string casing, an upper sleeve attached to said upper part of said string casing and said short tube which bears vertically against said flange, and a lower sleeve attached to said lower part of said string casing and said short tube; and wherein said continuity means includes openings through said seat.

* * * * *